US007393098B2

(12) United States Patent
Bich et al.

(10) Patent No.: US 7,393,098 B2
(45) **Date of Patent: *Jul. 1, 2008**

(54) LIQUID JET WRITING INSTRUMENT

(75) Inventors: Xavier Bich, Neuilly sur Seine (FR); Alain Rosenzweig, Saint Maur des Fosses (FR); Kurt Rath, Neuilly sur Seine (FR)

(73) Assignee: Société BIC, Clichy, Cedex (FR)

( * ) Notice: Subject to any disclaimer, the term of this patent is extended or adjusted under 35 U.S.C. 154(b) by 271 days.

This patent is subject to a terminal disclaimer.

(21) Appl. No.: 11/015,287

(22) Filed: Dec. 16, 2004

(65) Prior Publication Data

US 2005/0206690 A1 Sep. 22, 2005

(51) Int. Cl.
*B41J 3/36* (2006.01)

(52) U.S. Cl. ..... 347/109; 347/108; 347/8

(58) Field of Classification Search ..... 347/108, 347/109; 410/195, 29; 400/88
See application file for complete search history

(56) References Cited

U.S. PATENT DOCUMENTS

| | | | | |
|---|---|---|---|---|
| 6,846,077 | B2 * | 1/2005 | Bich et al. | 347/109 |
| 6,981,768 | B2 * | 1/2006 | Saksa et al. | 347/109 |
| 2002/0136587 | A1 | 9/2002 | Bramlett et al. | |
| 2003/0118394 | A1 | 6/2003 | King et al. | |

* cited by examiner

*Primary Examiner*—Lam S Nguyen
(74) *Attorney, Agent, or Firm*—Jones Day

(57) ABSTRACT

A writing instrument comprising a liquid spray head and a processor unit serving to activate the spray head. The instrument further comprises measurement means for measuring the distance between the spray head and the medium, and movement detector means, the processor unit being adapted to activate the liquid spray head when at least the measurement means determine that the distance between the spray head and the medium is less than a predetermined maximum value, the processor unit also being adapted to manage activation of the spray head as a function of the movement detected by the movement detector means.

14 Claims, 3 Drawing Sheets

LIQUID JET WRITING INSTRUMENT

FIELD OF THE INVENTION

The present invention relates to writing instruments that spray jets of a liquid such as ink.

ART PRIOR TO THE INVENTION

More particularly, among such writing instruments, the invention relates to those which comprise a substantially tubular element that extends between a first end and a second end and that is designed to be held by a user, said tubular element containing:

a reservoir of liquid;

a liquid spray system comprising a liquid spray head connected to the reservoir of liquid, the spray head being designed to spray the liquid onto a medium from a distance; and a processor unit serving to activate the liquid spray system so as to enable the spray head to spray the liquid onto the medium from a distance.

In known writing instruments of this type, the tubular element is generally provided with a feeler having a first end serving to come into contact with the medium during writing, and a second end connected to a detector mechanism for detecting the movements of the feeler in contact with the medium. That detector mechanism is connected to the processor unit in order to enable the liquid spray system to be activated. Thus, when the user is holding the writing instrument in the hand and when said user brings it towards the medium, the feeler comes into contact with the surface of the medium, thereby enabling the detector mechanism to send a signal to the processor unit in order to activate the spraying of the liquid.

Therefore, although the writing head, namely the liquid spray head, no longer needs to be in contact with the medium, it is however essential for the feeler of the writing instrument to be in contact with the medium in order to start spraying the liquid. However, spraying of liquid onto the medium is related only to whether or not the feeler is in contact with the medium, spraying of liquid then being constant and set at a predetermined flow rate so long as the feeler is in contact with the medium. Therefore, if the writing instrument is moved at high speed over the medium, the spray of liquid can be insufficient for properly forming a continuous line. Similarly, when the user moves the writing instrument slowly, too much liquid can be sprayed, thereby preventing a proper line from being formed.

OBJECTS AND SUMMARY OF THE INVENTION

An object of the present invention is to mitigate the above-mentioned technical problems by proposing a writing instrument that is reliable and simple, and that offers good writing comfort for the user.

To this end, the invention provides a writing instrument in which the tubular element further contains:

monitor means for monitoring the distance between the spray head and the medium, the monitor means being connected to the processor unit; and movement detector means for detecting movement of the spray head, the movement detector means being connected to the processor unit;

in which the processor unit is adapted to activate the liquid spray system when at least the monitor means determine that the distance between the spray head and the medium is appropriate; and in which the processor unit is adapted to cause the frequency and/or the amplitude of electrical signals for activating the liquid spray system to vary as a function of the movement detected by the movement detector means.

By means of these provisions, the user of the instrument activates the spraying of ink merely by moving the instrument to a suitable distance from the medium while imparting movement to it that is detected by the writing instrument so as to vary the frequency and/or the amplitude of the electrical signals for activating the liquid spray system. Such activation of spraying of the liquid can thus be stopped by the user either by keeping the hand and thus the instrument stationary or by moving the writing instrument and more exactly the liquid spray head away from the medium. This writing instrument thus makes it possible to cause liquid to be sprayed in controlled manner as a function of the speed of movement of the instrument under good conditions which are close to the writing conditions presently experienced with conventional writing instruments such as ball-point pens or felt-tip pens.

In preferred embodiments of the invention, use is further made of one or more of the following provisions:

the monitor means are formed by measurement means for measuring the distance between the spray head and the medium, and the processor unit is adapted to activate the liquid spray system when firstly the measurement means determine that the distance between the spray head and the medium is less than a predetermined maximum value, and secondly the movement detector means detect movement;

the measurement means are adapted to measure the distance between the spray head and the medium without physical contact between the writing instrument and said medium;

the processor unit is adapted to activate the liquid spray system when firstly the measurement means determine that the distance between the spray head and the medium lies in the range defined by a predetermined minimum value and by said predetermined maximum value, and when secondly the movement detector means detect movement;

the measurement means comprise an optical system serving to measure the distance between the spray head and the medium;

the movement detector means are formed by an accelerometer;

the movement detector means are formed by the optical system and by the processor unit that determines the speeds of movement of the spray head relative to the medium as a function of the measurements taken by the optical system;

the measurement means comprise an ultrasound acoustic probe serving to measure the distance between the spray head and the medium;

the monitor means are formed by an optical system adapted to measure the distance between the spray head and the place on the medium at which the liquid is to be sprayed;

the movement detector means are formed by the optical system and by the processor unit which is adapted to decrease the frequency and/or the amplitude of electrical signals for activating the spray system when the optical system detects the presence of liquid on the medium, which represents a decrease in the speed of movement of the writing system relative to the medium;

the tubular element further contains an electrical power source and switch means connected to the electrical power source, said switch means being actuatable by the user in order to switch on the liquid spray system, the processor unit, the monitor means and the accelerometer;

the tubular element further contains emitter means for emitting a visible light spot onto the medium in order to represent the point of impact of the liquid sprayed onto the medium;

the liquid spray head comprises at least one nozzle for spraying droplets of liquid, and the spray system further comprises an electrical signal generator for generating electrical signals for activating said at least one nozzle of the spray head;

the processor unit is adapted to activate communication means serving to emit a warning signal to the user when firstly the measurement means determine that the distance between the spray head and the medium is less than a predetermined maximum value, and when secondly the movement detector means do not detect any movement of the tubular element for a predetermined time interval; and when the liquid spray system has not been activated for a first time interval, the processor unit is adapted to activate, for a second time interval, communication means serving to emit an alarm signal, and then to activate the liquid spray system when the measurement means determine that the distance between the spray head and the medium is once again less than the predetermined maximum value, and when the movement detector means detect, once again, movement of the tubular element.

DESCRIPTION OF THE DRAWINGS

Other characteristics and advantages of the invention appear from the following description of embodiments thereof, given by way of non-limiting example, and with reference to the accompanying drawings.

In the drawings.

MORE DETAILED DESCRIPTION

In the various figures, like references designate elements that are identical or similar.

Figure 1:
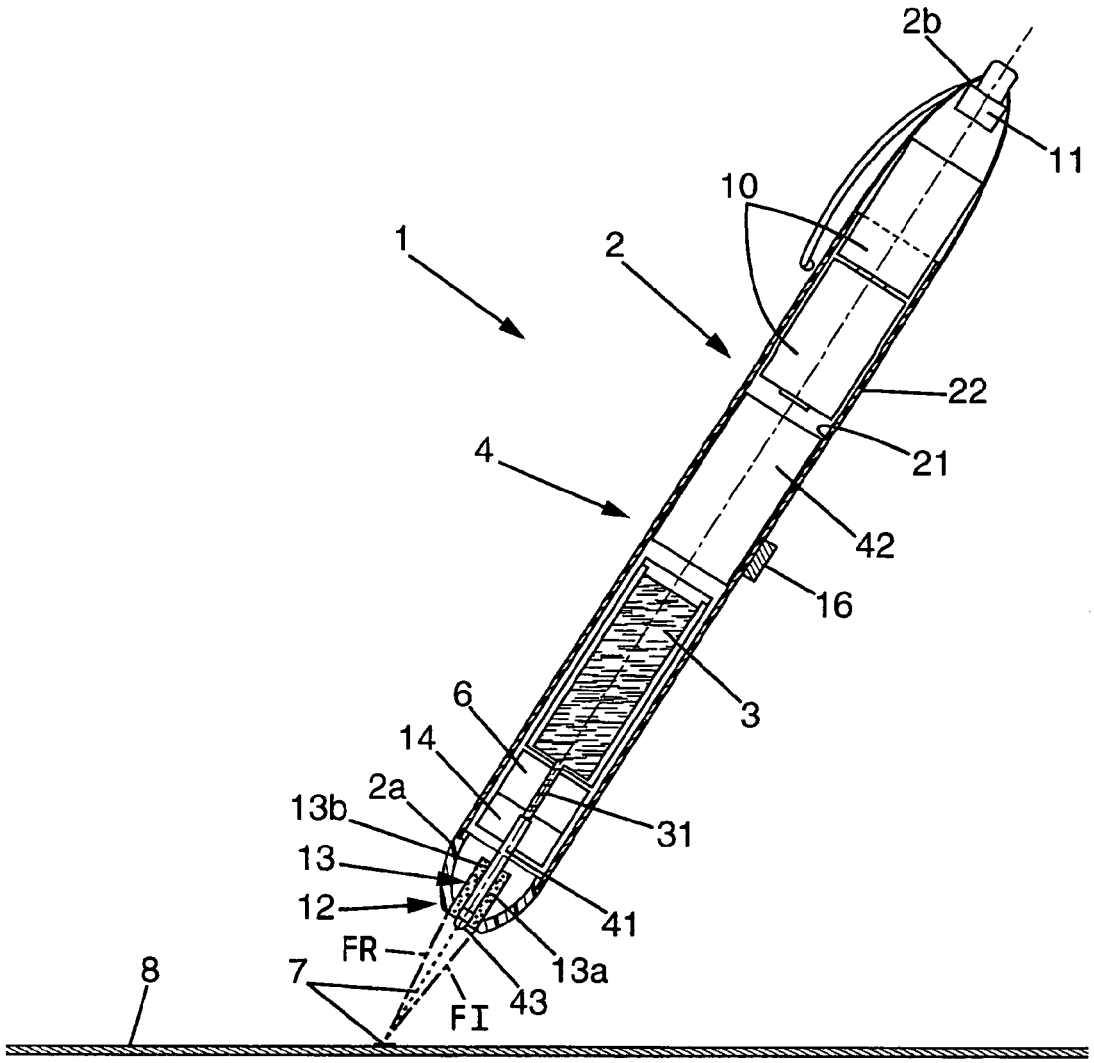
FIG. 1 is a diagrammatic view of a first embodiment of a writing instrument of the invention.

FIG. 1 shows a writing instrument 1 that includes a substantially tubular element 2 which extends between a first end 2*a* and a second end 2*b*. Said tubular element 2 has an inside wall 21 defining a hollow inside space, and an outside wall 22 designed to be held by a user.

The hollow inside space defined by the inside wall 21 of the tubular element 2 contains a reservoir of liquid 3 and a spray system 4 for spraying said liquid, said spray system being associated directly with the reservoir 3. The reservoir of liquid 3 is removably mounted in the hollow inside space in the tubular element 2 so as to be replaced with another reservoir after said liquid has been used up. Depending on the use to be made of the instrument, the liquid contained in said reservoir can be formed of ink, or of an ink-erasing or ink-masking liquid when the instrument is used as a corrector, or even of adhesive when said instrument is used as an adhesive applicator or spray. The spray system 4 is formed by a liquid spray head 41 connected directly to the reservoir of liquid 3 via a channel 31, and by an electrical signal generator 42 designed to control activation and deactivation of said spray head 41.

In the example considered herein, the spray head 41 is a piezoelectric spray head that includes a spray nozzle 43 disposed at the end 2*a* of the tubular element 2. Said end 2*a* of the tubular element can be constituted by an end-piece fitted directly into the central portion of the tubular element 2 over the inside wall 22 of said central portion. Said end-piece 2*a* presents an end orifice inside which the nozzle 43 of the spray head 41 is disposed. The spray nozzle 43 can be mounted in fixed manner on the end-piece 2*a* or in retractable manner by means of a suitable mechanism so that said nozzle can be housed inside the end-piece, thereby avoiding any risk of said nozzle being damaged while the writing instrument is not being used. In a manner known per se, the spray head 41 includes a piezoelectric element adapted to deform when it is subjected to the electrical signals coming from the generator 42, thereby forming micro-droplets 7 at the spray nozzle 43 that are sprayed onto the medium 8.

The liquid spray system 4 can also be formed by a substrate, e.g. made of glass, on which at least one resistive heater element is mounted, positioned at at least one small-size channel containing a small quantity of ink coming from the reservoir 3. Thus, when an electrical signal is generated by the generator 41 on the resistive element, the temperature of said resistive element rises instantaneously, thereby forming a bubble of vapor in the ink, which bubble expels a fine droplet 7 of liquid onto the medium 8.

The writing instrument also includes a processor unit 6 designed to activate the generator 42 for generating electrical signals (or electrical pulses) in order to enable the spray nozzle 43 of the spray system to spray the droplets 7 onto the medium 8 from a distance. At its end 2*b*, the hollow inside space of the tubular element 2 also contains an electrical power source formed, for example by a battery, or even two batteries, rechargeable or otherwise, making it possible, by means of a switch 11 to switch on the various electrical elements forming the writing instrument. The switch 11 can be replaced with any other switch means that are suitable for being actuated by the user of the instrument, and in particular with detector means for detecting whenever the user takes hold of the tubular element 2, such as, for example, a capacitive sensor disposed at the outside wall 22 of the tubular element 2, and designed to detect a pressure whenever the user takes hold of the instrument.

The end 2*b* of the tubular element 2 can, for example, be in the form of a cap removably mounted on the central portion of said tubular element 2 in order to enable two worn batteries 10 to be replaced with new batteries.

At its end 2*a*, the tubular element 2 also includes monitor means 12 for monitoring the distance between the spray head 41 and the medium 8. The monitor means 12 can be formed by a feeler connected to a detector which is itself connected to the processor unit 6. In the example considered herein, the monitor means are formed by measurement means 12 for acting without any physical contact between the writing instrument and the medium 8 to measure the distance between the spray head 41 and the medium 8. More exactly, the measurement means 12 are adapted to measure the distance between the spray nozzle 43 and the medium 8.

In this embodiment, the measurement means 12 are constituted by an optical system 13 which, for example, comprises an infrared light-emitting diode (LED) 13*a* which sends an incident light beam FI towards the medium 8 so as to form a light spot on said medium 8, and a reflected light beam FR. The light beams are then analyzed by a photodiode 13*b* so as to compute the angle of inclination of the incident beam FI relative to the medium 8.

Since the distance between the photodiode 13*b* and the infrared LED 13*a* is known, and since the angle of inclination of the incident light beam FI has been computed, simple trigonometric relationships then suffice to compute the distance between the infrared LED and the medium 8. The photodiode can be formed by a photodiode S6560 sold under the trademark HAMAMATSU.

In another variant embodiment, the optical system 13 can also include emitter means for emitting a conical light beam whose axis of symmetry coincides with the longitudinal axis of the tubular element 2. The optical system then includes a sensor adapted to compute the radius of the light spot formed by the conical beam on the medium 8. Since the radius of the light spot is proportional to the distance between the medium 8 and the emitter means for emitting the conical beam, it is then possible to determine, in linear manner, the distance between the emitter means and the medium. Similarly, if the axis of symmetry of the conical beam is inclined relative to the medium, the light spot formed on the medium is no longer circular but rather elliptical, and the sensor is also adapted to measure the length of the minor axis of the elliptical spot in order to determine the distance between the medium and the emitter means for emitting the conical beam. In which case, and regardless of the inclination of the writing instrument, the length of the minor axis of the elliptical spot is proportional only to the distance between the emitter means and the medium, only the length of the major axis of the elliptical spot being proportional to the inclination of the conical beam.

In a variant embodiment, the measurement means 12 can also be constituted by an ultrasound acoustic probe. In which case, the distance measured between the nozzle 43 and the medium 8 corresponds to the shortest distance between said nozzle 43 and the medium 8, independently of the inclination of the writing instrument relative to the medium 8.

Figure 2:
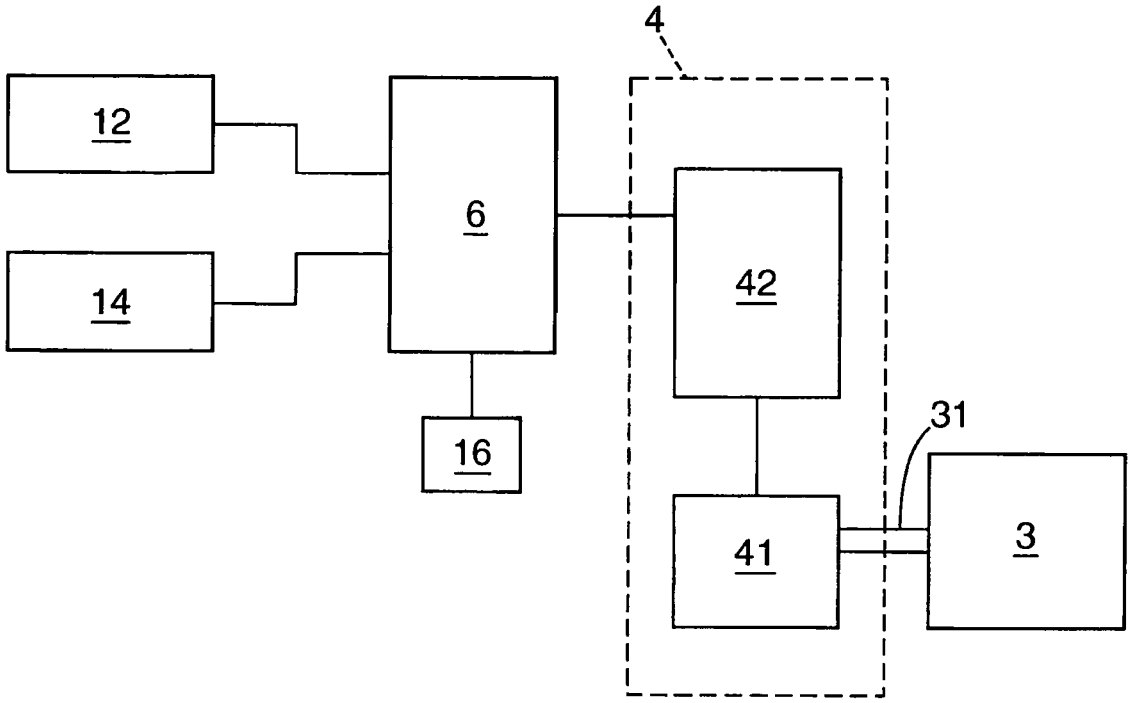
FIG. 2 is a block diagram of the various component elements of the first embodiment of the writing instrument of the invention.

As can be seen with reference to FIGS. 1 and 2, the optical system 13 that forms the measurement means 12 is connected directly to the processor unit 6 which stores in a memory the measurement taken by the optical system 13. The processor unit can also be adapted to cause the optical system 13 to perform measurement operations repeated at determined time intervals. For example, the time intervals could lie in the range 1 millisecond (ms) to 0.1 seconds . ..

The tubular element 2 also includes movement detector means which, in the first embodiment of the invention shown in FIGS. 1 and 2, are formed by an accelerometer. The accelerometer 14 is connected directly to the processor unit and it can be disposed anywhere inside said tubular element. By way of example, the accelerometer can be disposed at the end 2*b* of the tubular element so as to be subjected to the movements having the largest amplitude while the user is using the writing instrument.

Operation of the writing instrument is now described with reference to FIGS. 1 and 2.

When the user wishes to use the writing instrument 1 for writing on a medium 2, the user firstly switches on the various electrical elements of said writing instrument by actuating the switch 11.

The user then moves the end of the writing instrument towards the medium 8 so that the measurement means formed by the optical system 13 act automatically and without any physical contact with the medium 8 to compute the distance between the spray nozzle 43 and the medium 8. Similarly, the writing instrument moving towards the medium 8 is detected by the accelerometer 14 which sends a detection signal directly to the processor unit 6.

Said processor unit 6 is adapted to activate the liquid spray system 4 and thus to cause the droplets 7 to be sprayed onto the medium 8 only when the accelerometer 14 detects movement of the writing instrument and when the measurement means 12 formed by the optical system 13 determine that the distance between the spray nozzle 43 and the medium 8 is less than a predetermined maximum value.

For example, said predetermined maximum value can be about 1 centimeter (cm).

Thus, when the measurement means 12 determine that the distance between the nozzle 43 and the medium 8 is greater than the predetermined maximum value and when the accelerometer detects movement of the writing instrument, the processor unit 6 does not activate the spray system and no droplet is sprayed onto the medium 8.

Likewise, the processor unit 6 does not cause droplets to be sprayed when the instrument is not in motion, even if the nozzle 43 is at a suitable distance from the medium, i.e. at a distance less than the predetermined maximum value.

The accelerometer thus sends all of the acceleration and deceleration measurements to the processor unit 6 in real time, depending on the movements that the user applies to the writing instrument. Depending on the measurements taken by the accelerometer, the processor unit 6 can then control the electrical signal generator 42 so as to vary the frequency and/or amplitude of the electrical signals sent directly to the liquid spray head 41, thereby varying the size of the droplets 7 and/or the frequency of spraying of the droplets 7 onto the medium 8.

By way of example, if the user moves the writing instrument rapidly while it is being used, the accelerometer then sends to the processor unit the measurement of the acceleration so that said processor unit 6 increases the frequency of the electrical signals so as to increase the frequency of spraying of the droplets 7. A line that is as continuous as possible is thus formed on the medium 8, by avoiding the formation of a pattern or a discontinuous line made up of succession of variously spaced apart droplets.

Conversely, when the accelerometer measures a deceleration, the processor unit 6 can then reduce proportionally the frequency of the electrical signals so as to reduce the frequency of spraying of the droplets 7. Such a reduction in the frequency of spraying of the droplets 7 makes it possible to avoid delivering too much liquid for forming a pattern when the writing instrument is moved at low speed.

Figure 3:
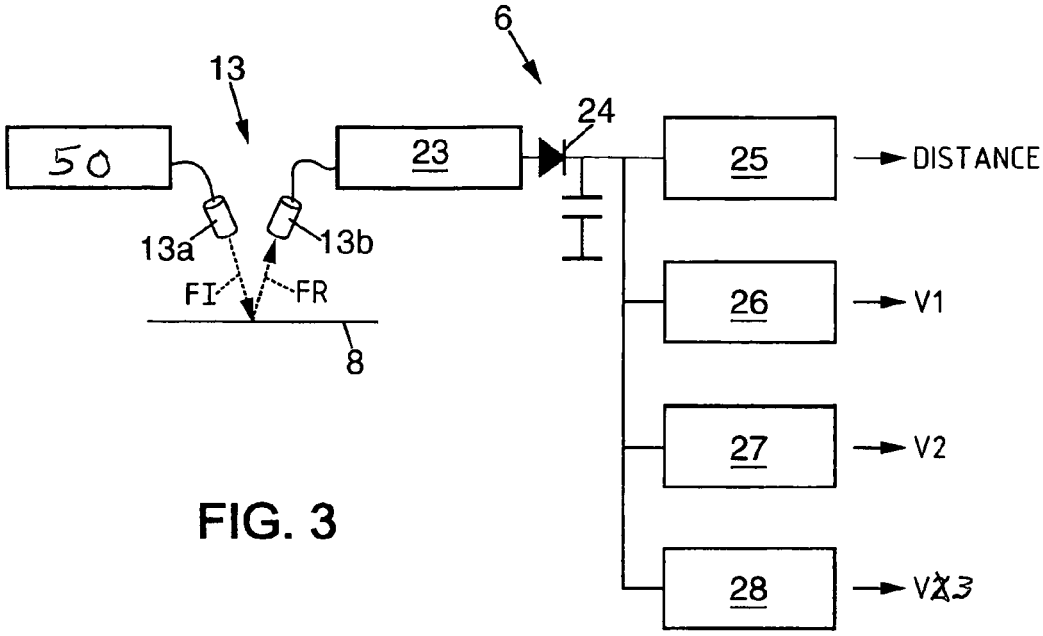
FIG. 3 is a block diagram diagrammatically showing the detector means for detecting movement of a second embodiment of the writing instrument.

In a second embodiment of the invention, shown in FIG. 3, the movement detector means are formed by the optical system 13 and by the processor unit 6 which determines the speeds or ranges of speeds of movement of the spray head 41 relative to the medium 8 as a function of the measurements taken by the optical system 13.

More particularly, in said second embodiment, the optical system 13 can also include an infrared LED 13*a* which is, for example, modulated by means of a modulator 50 so as to reduce the possibility of interference with other light sources. In this way, the infrared LED 13*a* emits an incident light beam FI towards the medium 8 in order to form a light spot on said medium and a reflected light beam FR which is then analyzed by a photodiode 13*b*. To this end, the reflected light beam FR or the reflected signal is detected and measured by using a photodiode making it possible to remove the effects of the interference in order to make the measurements more reliable.

Thus, in said second embodiment, it is proposed for the optical system 13 to be used in co-operation with the control unit 6 to deliver both an estimate of the distance between the spray head 41 and the medium 8, and also an estimate of the speed of movement of said spray head 41 relative to the medium 8. In this case, the optical system 13 or more precisely the infrared LED 13*a* and the corresponding photodiode 13*b* are arranged at the spray head 41 in a manner such that the optical system can see or observe a small zone of the medium 8 that is relatively close to the zone on which the droplets of liquid are to be deposited, without being exactly superposed on said zone on which the drops of liquid 7 are to be deposited. This system requires the zone on the medium that is observed by the optical system 13 to be relatively small so that it can be advantageous to use a lens system in order to focus the various reflected light beams onto a zone that is as small as possible so as to preserve the components of the reflected signal that relate to the speed at which the writing instrument moves relative to the medium 8.

For example, the infrared LED 13*a* is modulated so as to economize the power used and in order to filter out background noise as effectively as possible. A typical modulation frequency can, for example, lie in the range 25 kilohertz (kHz) to 30 kHz or even higher, while avoiding the frequency band lying between 38 kHz and 40 kHz, which band is often used, for example, by infrared remote control systems for television sets.

As can be seen in FIG. 3, the photodiode 13*b* detects the signal reflected directly from the surface of the medium 8, and said signal is amplified by means of a preamplifier 23 coupled in alternating current (AC) mode. Said preamplifier 23 has a pass-band frequency response that is centered around the infrared modulation frequency so as to enable the undesired signals to be removed. In practice, a plurality of AC coupled amplification stages can be necessary. However, the various AC coupled stages can be situated after the demodulator 24 situated directly downstream from the preamplifier 23.

The AC signal obtained by means of the preamplifier 23 is then demodulated by the demodulator 24. Additional resistive components can also be added so as to alter the charge and discharge time constants as a function of the frequency response of the detected signals.

The demodulated AC signal is then sent to a low-pass filter 25 so as to determine the amplitude of the demodulated signal which is representative of the distance between the optical system 13 and the medium 8. The low-pass filter reduces undesired noise by smoothing the signal slightly. An upper cutoff frequency lying in the range 50 hertz (Hz) to 100 Hz, for example, can be suitable for said low-pass filter.

The demodulated signal is also amplified again in AC mode so as to extract the data relating to the speed of movement of the writing instrument relative to the medium 8. When the writing instrument is stationary relative to the medium 8, the amplitude of the demodulated signal remains constant and no additional AC component is superposed on the demodulated signal. However, when the writing instrument is moved relative to the medium 8, the demodulated signal changes amplitude depending on changes in distance between the writing instrument and the medium 8, and also depending on local changes in reflectivity of the paper. As a function of the optical system chosen, said changes in amplitude of the demodulated signal can relate to the medium 8, to the texture of the surface of the medium 8, to visible marks, or also to lines already formed by means of spraying droplets of liquid onto the medium. In conventional manner, when the writing instrument is moved relative to the medium 8, additional AC components become added to the amplitude of the demodulated signal with an order of magnitude of a few kHz as a function of the speed of movement of the writing instrument relative to the medium 8.

Thus, the frequency components buried in the demodulated signal are representative of the speed of movement of the writing instrument relative to the medium 8. Said additional frequency components that can be likened to noise that is buried in the demodulated signal and that are representative of the speed of the writing instrument can be analyzed in various manners. For example, by means of three filters 26, 27, and 28, each of which has a predetermined pass-band so as to extract three different ranges of speeds, namely a slow-speed first range of speeds V1 of the writing instrument relative to the medium 8, an average-speed second range of speeds V2, and a high-speed third range of speeds V3.

Digital processing of the signals sensed by means of the photodiode 13*b* can also be used such as, for example, detecting zero crossings.

Thus, when the writing instrument is stationary relative to the medium 8, no noise relating to the movement and to the speed of the writing instrument is present in the demodulated signal. Conversely, when the writing instrument is moved without contact relative to the medium 8, noise is automatically generated in the demodulated signal as a function of the type of surface of the medium 8, and said noise tends to increase in frequency when the writing instrument is moved increasingly fast relative to the medium 8.

In a variant embodiment, the optical system 13 can also include two photodiodes 13*b* which are arranged so as to observe two adjacent regions within the light spot obtained by means of the infrared LED 13*a* on the medium 8. The electronic circuit used then compares the signals received from the two photodiodes 13*b* so as to generate an output signal when a significant difference exists between the two demodulated signals obtained. The various output signals thus generated can be analyzed and, for a given surface, the frequency of the signals then reflects the speed of movement of the writing system relative to the medium 8.

In addition, in a variant embodiment, it is possible for the optical system 13 not to be provided with lenses, but instead with collimators, e.g. implemented by means of an optically black tube, having respective disks provided with very small-size apertures mounted at its ends.

The infrared LED 13*a* can also be replaced with an infrared laser diode.

In a variant embodiment, the processor unit 6 can also be adapted to stop activating the liquid spray system when the spray nozzle 43 is too close to the medium 8 for droplets of liquid 7 to be sprayed properly onto the medium. In which case, the processor unit 6 activates the liquid spray system only if the movement detector means 14 or 13 detect movement of the writing instrument relative to the medium and if the optical system 13 determines that the distance between the spray nozzle 43 and the medium 8 lies in a range of values defined by a predetermined minimum value and by a predetermined maximum value.

Similarly, in order to improve user writing comfort, the processor unit 6 can be adapted to activate communication means 16 designed to emit an alarm signal when firstly the optical system 13 determines that the distance between the ink spray head 41 and the medium 8 is less than a predetermined maximum value, and when secondly the accelerometer 14 or the optical system 13 together with the processor unit 6 does not detect any movement of the spray head 41 relative to the medium 8 for some predetermined time interval. For example, said communication means 16 can be in the form of an emitter for emitting visible light signals or of an emitter for emitting audible sound signals, thereby enabling the user to know when the liquid spray head 41 or more exactly the spray nozzle 43 is at a distance from the medium suitable for enabling the electrical signal generator 42 to be activated, and that movement, even accidental movement, of the writing instrument can cause the spray system 4 to be activated and thus droplets of liquid to be sprayed onto the medium 8.

Similarly, in order to improve user writing comfort, the processor unit 6 can be adapted to activate the communication means 16 in order to emit an alarm signal when the liquid spray system 4 has not been activated for some given time interval (e.g. 30 seconds or 1 minute), and when the measurement means 12 detect that the distance between the spray head 41 and the medium 8 is suitable once again, and when the movement detector means 14 or 13, 6 detect movement of the writing instrument again. In which case, the processor unit activates the communication means for, for example, a maximum of two seconds in order to warn the user that the spraying of liquid is imminent, and, after said maximum time interval of two seconds, the processor unit 6 then activates the liquid spray system 4.

When the measurement means 12 are formed by an ultrasound acoustic probe, the tubular element 2 can also be provided, at its end 2*a*, with emitter means for emitting a visible light spot onto the medium 8, said light spot serving to represent the point of impact of the droplets 7 on the medium.

Figure 4:
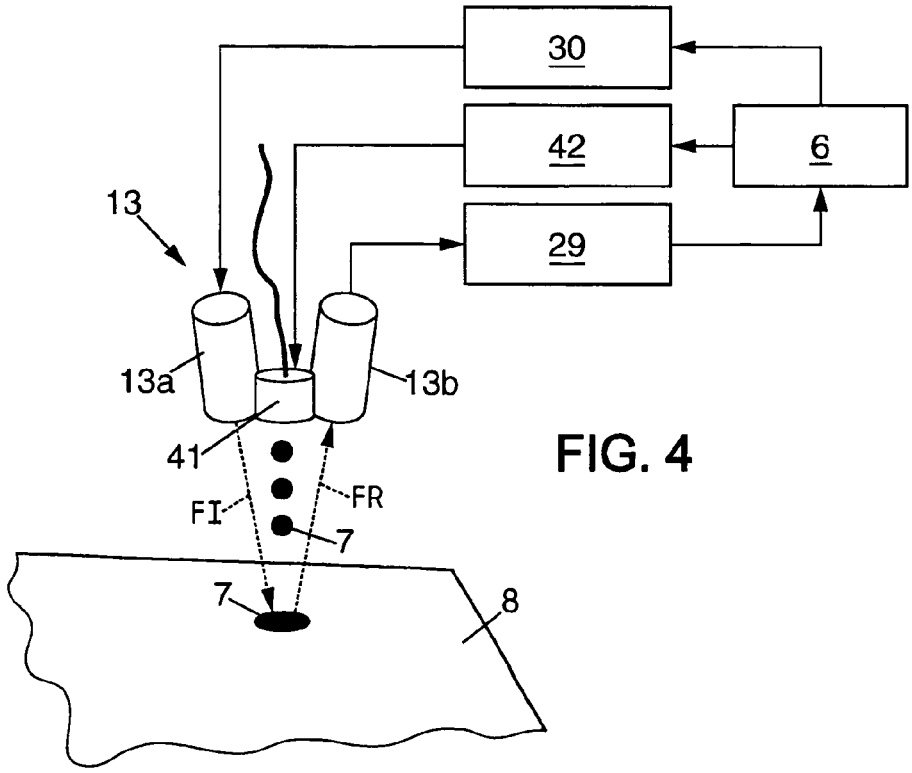
FIG. 4 is a block diagram diagrammatically showing the detector means for detecting movement of a third embodiment of the writing instrument.

FIG. 4 shows a third embodiment of the movement detector means which, in this example, are formed by an optical system 13 and by the processor unit 6 which is then adapted to reduce the frequency and/or the amplitude of the electrical signals for activating the spray head 41 when the optical system 13 detects the presence of liquid 7 on the medium 8, which is then representative of a reduction in the speed of movement of the writing system as a whole relative to the medium 8. More exactly, as can be seen in FIG. 4, the optical system is still formed by an infrared LED 13*a* and by a corresponding photodiode 13*b* that are equipped with a system of lenses or of collimators so as to make it possible both to determine the distance between the spray head 41 and the medium 8, and also to examine the zone of the medium 8 on which the droplets 7 are to be deposited. The optical system, or more exactly the LED 13*a* and the photodiode 13*b* must be arranged relative to the spray head 41 so that the incident light beam FI and the reflected light beam FR are focused accurately onto the zone in which the droplets 7 are to be deposited. The signals obtained from the photodiode 13*b* are then processed by means of a preamplifier and of a phase detector 29 so as to send the information to the processor unit 6 which then, in turn, firstly controls the control circuit or the electrical signal generator 42 powering the spray head 41, and secondly controls the control circuit of the infrared LED 13*a*.

The processor unit 6 is adapted to enable droplets 7 to be ejected from the spray head 41 at a maximum frequency when the distance between the spray head 41 and the medium 8 lies in a suitable range and when the optical system 13 does not detect the presence of liquid 7 on the medium 8. In which case, the processor unit 6 causes the droplets 7 to be ejected onto the medium 8 as shown in FIG. 4.

If the writing instrument remains stationary relative to the medium 8, the optical system 13 then automatically detects the presence of liquid on the medium 8 so that the processor unit 6 significantly reduces or even stops the spraying of droplets 7 onto the medium. As soon as the writing instrument is moved, the optical system 13 finds itself facing a blank zone of the medium 8 so that the processor unit 6 causes the droplets to be ejected at maximum frequency. Conversely, as soon as the speed of the writing instrument decreases relative to the medium 8, the optical system 13 is then suitable for detecting the presence of droplets in register with the spray head 41 so that the processor unit 6 then automatically reduces the frequency and/or the amplitude of the electrical signals sent by the signal generator 42 to the spray head 41.

In said third embodiment shown in FIG. 4, the liquid used or the ink used can have reflectivity properties that are suitable relative to the optical system 13 so that each droplet of liquid 7 deposited on the medium 8 is automatically detected by said optical system 13.

The invention claimed is:

1. A writing instrument comprising a substantially tubular element that extends between a first end and a second end and that is designed to be held by a user, said tubular element comprising:

a reservoir of liquid;

a liquid spray system comprising a liquid spray head connected to the reservoir of liquid, the spray head being designed to spray the liquid onto a medium from a distance; and a processor unit serving to activate the liquid spray system so as to enable the spray head to spray the liquid onto the medium from a distance, the tubular element further comprising:

monitor means for monitoring the distance between the spray head and the medium, the monitor means being connected to the processor unit; and movement detector means for detecting movement of the spray head, the movement detector means being connected to the processor unit, wherein the processor unit is adapted to activate the liquid spray system when at least the monitor means determine that the distance between the spray head and the medium is appropriate; and wherein the processor unit is adapted to cause the frequency or the amplitude of electrical signals for activating the liquid spray system to vary as a function of the movement detected by the movement detector means.

2. An instrument according to claim 1, in which the monitor means are formed by measurement means for measuring the distance between the spray head and the medium, and the processor unit is adapted to activate the liquid spray system when firstly the measurement means determine that the distance between the spray head and the medium is less than a predetermined maximum value, and secondly the movement detector means detect movement.

3. An instrument according to claim 2, in which the measurement means are adapted to measure the distance between the spray head and the medium without physical contact between the writing instrument and said medium.

4. An instrument according to claim 2 or claim 3, in which the processor unit is adapted to activate the liquid spray system when firstly the measurement means determine that the distance between the spray head and the medium lies in the range defined by a predetermined minimum value and by said predetermined maximum value, and when secondly the movement detector means detect movement of the tubular element.

5. An instrument according to claim 2, in which the measurement means comprise an optical system serving to measure the distance between the spray head and the medium.

6. An instrument according to claim 5, in which the movement detector means are formed by the optical system and by the processor unit that determines the speeds of movement of the spray head relative to the medium as a function of the measurements taken by the optical system.

7. An instrument according to claim 2, in which the measurement means comprise an ultrasound acoustic probe serving to measure the distance between the spray head and the medium.

8. An instrument according to claim 2, in which the processor unit is adapted to activate communication means serving to emit a warning signal to the user when firstly the measurement means determine that the distance between the spray head and the medium is less than a predetermined maximum value, and when secondly the movement detector means do not detect any movement of the tubular element for a predetermined time interval.

9. An instrument according to claim 2, in which, when the liquid spray system has not been activated for a first time interval, the processor unit is adapted to activate, for a second time interval, communication means serving to emit an alarm signal, and then to activate the liquid spray system when the measurement means determine that the distance between the spray head and the medium is once again less than the predetermined maximum value, and when the movement detector means detect, once again, movement of the tubular element.

10. A writing instrument according to claim 1, in which the movement detector means are formed by an accelerometer.

11. A writing instrument according to claim 1, in which the monitor means are formed by an optical system adapted to measure the distance between the spray head and the place on the medium at which the liquid is to be sprayed; the movement detector means are formed by the optical system and by the processor unit which is adapted to decrease the frequency or the amplitude of the electrical signals for activating the spray system when the optical system detects the presence of liquid on the medium, which represents a decrease in the speed of movement of the writing system relative to the medium.

12. An instrument according to claim 1, in which the tubular element further contains an electrical power source and switch means connected to the electrical power source, said switch means being actuatable by the user in order to switch on the liquid spray system, the processor unit, the monitor means and an accelerometer.

13. An instrument according to claim 1, in which the tubular element further contains emitter means for emitting a visible light spot onto the medium in order to represent the point of impact of the liquid sprayed onto the medium.

14. An instrument according to claim 1, in which the liquid spray head comprises at least one nozzle for spraying droplets of liquid, and the spray system further comprises an electrical signal generator for generating electrical signals for activating said at least one nozzle of the spray head.

* * * * *